US005333769A

United States Patent [19]

Skroski

[11] Patent Number: 5,333,769

[45] Date of Patent: Aug. 2, 1994

[54] INFANT CARRIER APPARATUS AND METHOD

[76] Inventor: Mitchell E. Skroski, 8 Hunter's Ridge Dr., Ashville, N.C. 28803

[21] Appl. No.: 99,736

[22] Filed: Jul. 29, 1993

[51] Int. Cl.[5] ..... A61G 1/013

[52] U.S. Cl. ..... 224/158; 224/209; 5/413; 5/655

[58] Field of Search ..... 224/155, 156, 158, 159, 224/160, 161, 202, 209; 294/140, 141; 2/69.5; 5/413, 462, 659, 94, 655; 297/219.12, 219.1, 224, 228.11, 229, 256.17; 140/1, 2, 109

[56] References Cited

U.S. PATENT DOCUMENTS

| | | | |
|---|---|---|---|
| 2,551,509 | 5/1951 | Smith | 294/140 |
| 2,628,358 | 2/1953 | Niels | 2/69.5 |
| 2,804,249 | 8/1957 | Manalo . | |
| 2,846,699 | 8/1958 | Watson . | |
| 3,096,917 | 7/1963 | Gudiksen | 294/140 |
| 3,269,621 | 8/1966 | Dishart | 5/462 X |
| 4,068,786 | 1/1978 | Taniguchi | 294/141 X |
| 4,698,862 | 10/1987 | Mairs | 5/98 R |
| 4,717,056 | 1/1988 | Carmichael | 224/158 |
| 4,730,759 | 3/1988 | Naidu | 224/158 |
| 4,757,925 | 7/1988 | Knittel | 224/158 |
| 4,883,701 | 11/1989 | Rankin et al. | 297/219.12 X |
| 5,243,724 | 9/1993 | Barnes | 297/219.12 X |

*Primary Examiner*—Glenn T. Barrett

[57] ABSTRACT

An infant carrier configured to serve also as a diaper bag, bassinet, and changing surface for an infant. Adjustable straps securely support the infant carrier when the straps are worn across the body and over the shoulder of the person. The infant carrier is configured as a bassinet having raised sidewalls and a cover releasably engaged to the upper edge of the sidewalls, the cover thereby being held in spaced relationship to the bed. The cover and foot sidewall are configured to be opened outwardly from the bassinet and oriented in a position that is coplanar to the bed thereby creating a changing surface. The infant carrier includes various pockets in the foot sidewall and cover to thereby incorporate the features of a diaper bag into the infant carrier. The entire body of the infant carrier is constructed of a fabric that is washable. A support board is received in a pocket beneath the bed to provide the proper support for the bed.

21 Claims, 4 Drawing Sheets

INFANT CARRIER APPARATUS AND METHOD

BACKGROUND

1. Field of the Invention

This invention relates to infant carriers and, more particularly, to a novel infant carrier apparatus and method whereby the infant carrier serves not only as a shoulder mountable carrier for carrying the infant in front of the person in a horizontal, face-to-face, essentially hands-free orientation, but also as a combination diaper bag, changing surface, and portable crib.

2. The Prior Art

Infant care, particularly for a newborn infant, is a 24 hour commitment requiring constant vigilance by the care giver. This care also entails the ready availability of numerous items necessary for the feeding, protection, warmth, comfort, and cleanliness of the infant. Accordingly, when it is necessary to transport the infant either by hand, in a stroller, or in the automobile, it is also necessary to transport appropriate types and quantities of infant care articles such as diapers, wash cloths, clothing, bedding, feeding bottles, and the like.

Over the centuries various devices have been employed for transporting an infant from place to place. These devices range from the cradle board to which the infant was snugly laced to a simple shawl by which the infant was held against the body of the person carrying the infant. More recent devices include backpack-like carriers, frontal carriers, and portable car seat/rocker combinations.

Almost without exception, these prior art devices carry the infant in either a seated or a near-vertical orientation. However, it is a well-known fact that an infant, particularly an infant in the first few months of life has very poorly developed neck muscles coupled with a very poor ability to control the neck muscles. The result is that the infant's head, unless restrained, tends to loll about often resulting in possible stress injuries to the neck or contact injuries to the head of the infant.

A more recent development is that of an infant seat/-carrier configured with a contoured shell having a carrying handle hingedly mounted to the shell. The infant is strapped into the carrier in a near sitting position and the carrier is transported about using the handle to carry the shell like a basket. The shell can be placed on the floor where it serves as a rocker for the infant. The handle can also be pivoted downwardly where it can be used as a brace to prevent the shell from rocking when placed against the surface.

Various other types of infant carriers are known in the art and include, for example, Smith (U.S. Pat. No. 2,551,509). This patent discloses an infant carrier configured as a cot having a substantially rectangular base with a surrounding, raised sidewall. A pair of straps provide a carrying handle for the cot.

Manalo (U.S. Pat. No. 2,804,249)discloses an infant carrier configured as a sling suspended from a shoulder harness. A pocket is formed in at least one of the vertical risers of the sling.

Watson (U.S. Pat. No. 2,846,699) discloses an infant carrier configured as a bassinet having an across-the-body shoulder strap for carrying the bassinet.

Dishart (U.S. Pat. No. 3,269,621) discloses a cradle-like baby carrier wherein the baby is strapped to the carrier. The carrier includes pockets for baby accessory and may be worn by an adult to carry the baby in the piggy-back position.

Mairs (U.S. Pat. No. 4,698,862) discloses a combination bassinet, baby carrier and diaper bag all of which are configured as a collapsible shell which can be folded flat for storage and unfolded to carry the baby in either an upright or prone position.

Carmichael (U.S. Pat. No. 4,717,056) discloses an infant carrier having carrier straps and an adjustable hood.

Knittel (U.S. Pat. NO. 4,757,925) discloses a baby carrier having a pouch with an adjustable shoulder strap connected to each end of the pouch.

From the foregoing it is clear that numerous devices for transporting an infant and associated accessories are known in the art. However, infant transportation is only one aspect of infant care that requires proper attention. In particular, an infant requires changing of soiled diapers on a frequent basis. This is done by removing the infant from the carrier and placing him/her on a surface to enable the care giver to change the diaper. However, this is not always a desirable procedure since diaper changing frequently must take place in a public rest room, and it is most unwise to place an unprotected infant on the floor or counter top of a public rest room. Not only is the infant exposed to direct contact with a cold, hard surface but, more importantly, the infant is unnecessarily exposed to the disease organisms present in such places.

In view of the foregoing, it would be an advancement in the art to provide an infant carrier that not only serves as a carrier for securely carrying an infant, but also doubles as a changing surface and a diaper bag, as well as a bed away from home. Such a novel apparatus and method is disclosed and claimed herein.

BRIEF SUMMARY AND OBJECTS OF THE INVENTION

This invention relates to a combination infant carrier, diaper bag, changing surface and bassinet fabricated from a washable fabric and having a support board removably carried in a pocket underneath the bed portion of the infant carrier. A pair of straps are looped under the infant carrier and can be adjustably worn over the shoulder across the body of the person carrying the infant carrier. The infant carrier includes a raised sidewall at the head and two sides while the foot sidewall and cover are formed coextensive with the bottom to accommodate being folded outwardly to form the changing surface. Pockets are formed in the sidewalls and the cover to hold various infant care accessories. An elasticized hem forms a hood to protect the head of the infant and to help retain the infant in the infant carrier.

It is, therefore, a primary object of this invention to provide improvements in infant carriers.

Another object of this invention is to provide improvements in the method for carrying and caring for an infant.

Another object of this invention is to provide an infant carrier that includes a changing surface and associated accessaries for changing an infant.

Another object of this invention is to provide an infant carrier whereby the infant is carried adjacent the front of the person carrying the infant with the infant carried in the prone or near-prone position and in a face-to-face relationship.

Another object of this invention is to provide an infant carrier that is readily received in a stroller, car seat, and the like.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
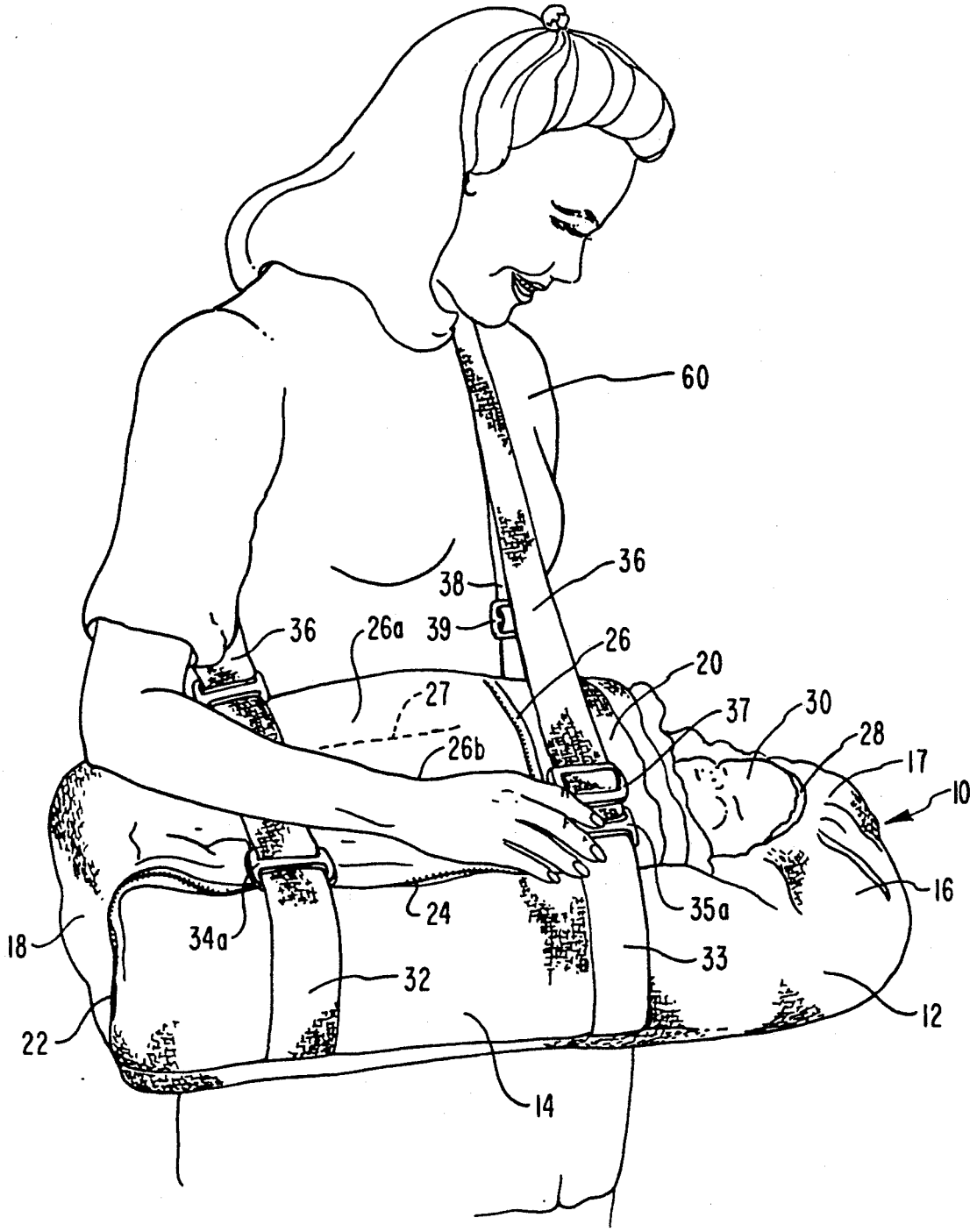
FIG. 1 is a perspective view of the novel infant carrier of my invention shown in the environment of an infant and a person carrying the infant.

The invention is best understood by reference to the drawing wherein like parts are designated by like numerals throughout in conjunction with the following description.

General Discussion

The novel infant carrier apparatus and method of this invention combines several devices into a single device. For example, my infant carrier combines the functions of a diaper bag with that of a bassinet with the bassinet being configured to serve as an infant carrier, stroller or car seat insert, as well as a changing surface. The bassinet is securely engaged by two carrying straps which can be looped over the shoulder and across the body of the person carrying the infant carrier to provide a secure, slip-free support for the infant carrier. This carrying position orients the infant in the most desirable orientation of face-to-face with the infant in the prone position.

The bassinet is designed with a generally rectangular bed portion surrounded by a raised sidewall at both sides and the designated head portion. The foot portion of the sidewall is formed as an extension of a cover, both of which are releasably engaged to the sidewalls by side zippers. The cover and foot portion of the sidewall are disengaged from the sidewalls and folded outwardly to cooperate in combination with the bed portion of the bassinet to form the changing surface.

A removable stiffener board is held in a pocket below the bed to provide a solid surface for the bed. Cutout sections along each side of the board partially conform the sides of the infant carrier to the body of the person carrying the infant carrier. This conformation of the infant carrier to the body of the person carrying it reduces the arcuate swinging of the infant carrier as the person walks since the center of rotation of the infant carrier has been changed from a single contact point to an elongated, arcuate-like surface with a correspondingly change in the center of gravity of the infant carrier.

Advantageously, my novel infant carrier doubles as a bed for the infant when away from home. This is important since infants are acutely sensitive to odors so that strange odors, for example from a strange bed, will significantly interfere with the infant's ability to sleep comfortably. While this may appear to be insignificant to an adult, it must be remembered that infants are easily upset by strange odors, sounds, and the like, so that it is important to surround the infant with as many familiar items as possible in a strange environment.

Perhaps one of the more important aspects of my novel infant carrier is that it provides the person carrying the infant with the ability to carry the infant in a normal, prone, face-to-face orientation and virtually hands free. Further, the infant carrier incorporates an elasticized hood portion to preclude inadvertent slippage of the infant from the infant carrier in the event the infant carrier is accidently tilted downwardly at the head.

DETAILED DESCRIPTION

Referring now to FIG. 1, the novel infant carrier apparatus of this invention is shown generally at 10 and includes a bassinet 12 having a bed 13 (FIGS. 2 and 3) surrounded by a pair of raised sidewalls 14 and 15 (FIGS. 2 and 3) in combination with a head sidewall 16 and a foot sidewall 18. A cover 20 extends over a substantial portion of bassinet 12. Foot sidewall 18 is formed as a segment of a cover 20. Bed 13, raised sidewalls 14 and 15, head sidewall 16, foot sidewall 18, and cover 20 are all fabricated from a washable fabric and are suitably padded. Cover 20 and foot sidewall 18 are releasably attached along each edge by zippers 24 and 25 to sidewalls 14 and 15, respectively. Foot sidewall 18 includes an outer foot pocket 22 while cover 20 includes a double pocket 26 divided by a seam 27 into pockets **26*a* and 26*b*. Pockets 26*a* and 26*b* are each specifically configured to hold a conventional nursing bottle (not shown). Head sidewall 16 includes an elasticized hood 17 with an elastic hem 28 to partially enclose the head of an infant (shown schematically herein as infant 30) to preclude infant 30 from sliding out of infant carrier 10 in the event infant carrier 10** is inadvertently tilted downwardly.

Figure 2:
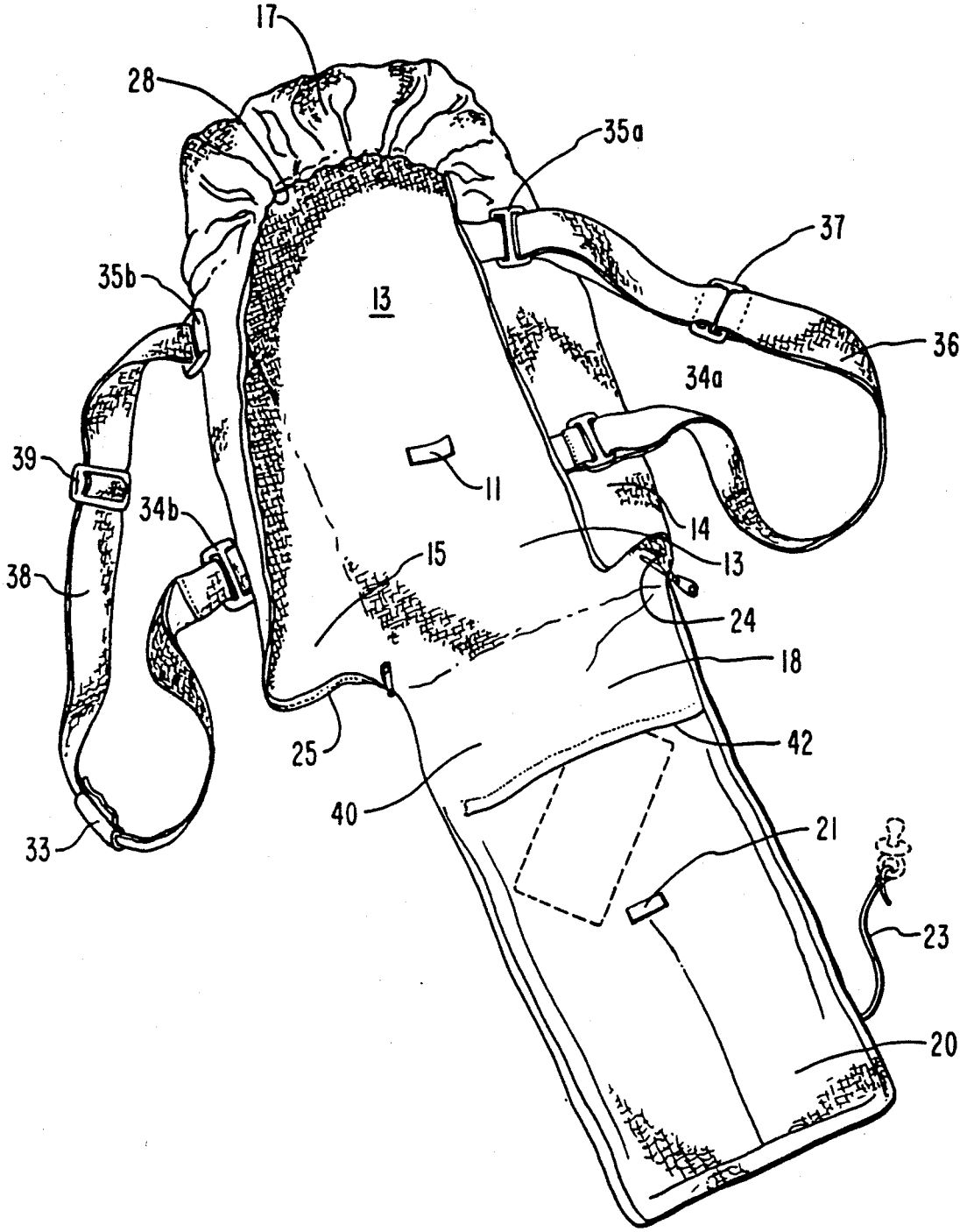
FIG. 2 is a perspective view of the infant carrier opened outwardly into the changing table configuration.

A pair of cross straps 32 and 33 pass underneath bed 13 (FIGS. 2 and 3) of bassinet 12 and are each sewn to bed 13 as well as sidewalls 14 and 15 (FIG. 2) to provide a secure anchor between bassinet 12 and cross straps 32 and 33. Cross strap 32 terminates at each end in couplings **34*a* and 34*b* while cross strap 33 terminates at each end in couplings 35*a* and 35*b*. A pair of carry straps 36 and 38 are attached to bassinet 12 at couplings 34*a* and 35*a* and couplings 34*b* and 35*b*, respectively, to provide bassinet 12 with its ease of portability. In particular, carry strap 36 is interconnected between couplings 34*a* and 35*a* while carry strap 38 is interconnected between couplings 34*b* and 35*b*. This particular arrangement of carry straps 36 and 38 provides them with a highly secure engagement of bassinet 12 while also allowing them to be opened outwardly as shown in FIGS. 2 and to provide completely open access to infant 30 as well as the contents of infant carrier 10. Carry strap 36 includes an adjustment buckle 37 and carry strap 38 includes an adjustment buckle 39 to provide each respective carry strap 36 or 38 with the capacity to be selectively adjusted in length. A closure 33 is attached to carry straps 38 and includes a hook and loop fastener system to enable carry straps 36 and 38** being releasably joined together.

Figure 3:
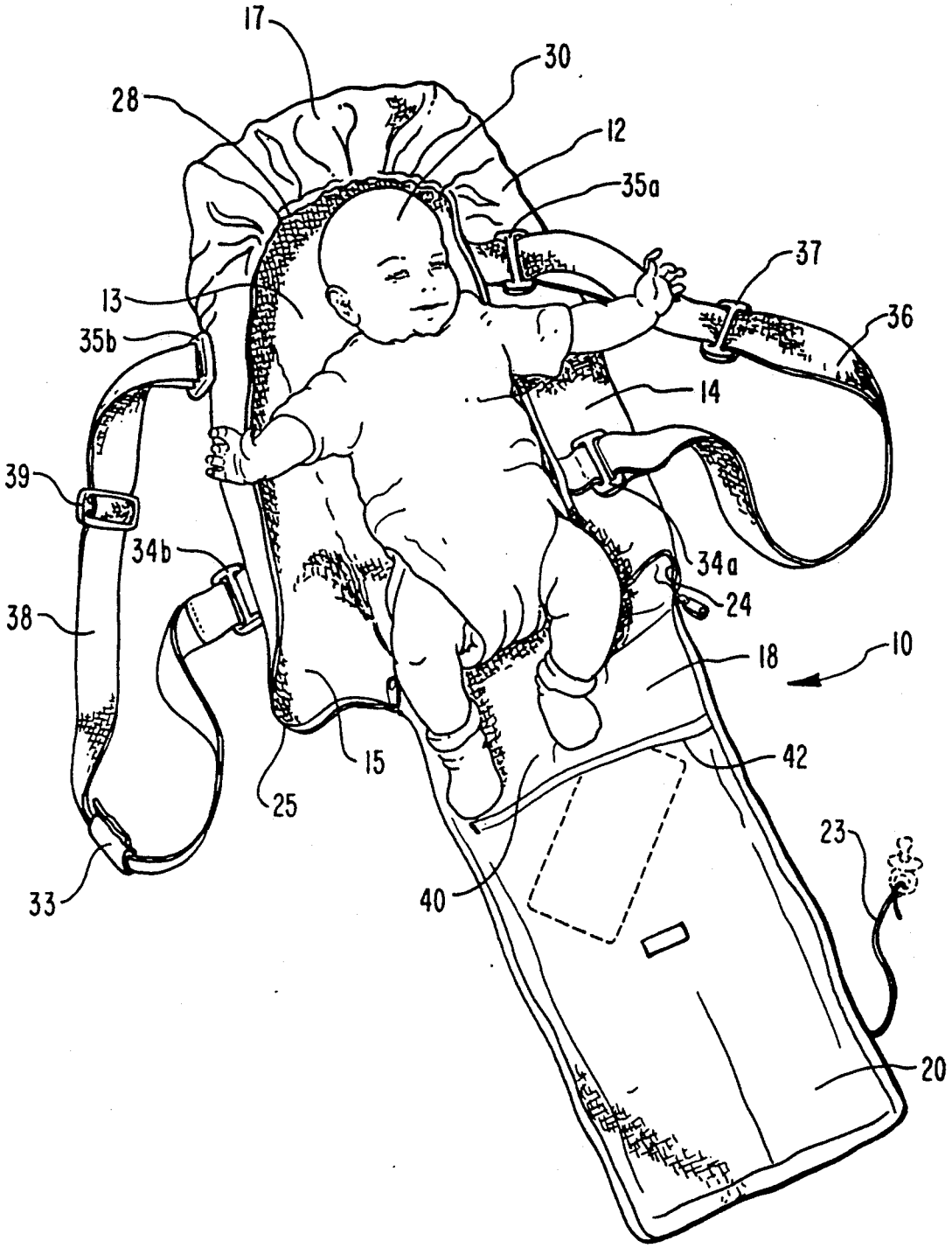
FIG. 3 is a perspective view of the infant carrier of FIG. 2 shown in the environment of an infant.

Referring now to FIGS. 2 and 3, infant carrier 10 is shown with cover 20 and foot sidewall 18 detached from sidewalls 14 and 15 and opened into an extended configuration with cover 20 and foot sidewall 18 oriented coplanar with bed 13 to thereby create changing surface 40. In particular, changing surface 40 is the common surface created from bed 13, foot sidewall 18 and cover 20 when foot sidewall 18 and cover 20 are opened outwardly into a configuration that is coplanar with bed 13. Infant carrier 10 opens outwardly to provide complete access to infant 30 whether for changing, dressing, or the like. Further, an internal pocket 42 is exposed providing access to diapers, wash cloths, etc., that may be selectively stored therein. Changing surface 40 protects infant 30 from contact with surfaces such as rest room counters or even floors when it becomes necessary to provide diaper change for infant 30. Infant 30 is protected not only from contact with a cold, hard surface but, more importantly, is protected from the filth customarily found in such public facilities.

Changing surface 40 readily reverts to being bed 13, foot sidewall 18, and cover 20 upon refolding foot sidewall 18 into the vertical orientation and placing cover 20 over bed 13 in a spaced relationship. Foot sidewall 18 and cover 20 are again attached to sidewalls 14 and 15 by engagement of zipper fasteners 24 and 25, respectively. Accordingly, infant carrier 10 is readily convertible from infant carrier 10 to changing surface 40 and back to infant carrier 10 by the simple expedient of changing the relative orientation of foot sidewall 18 and cover 20. A lanyard 23 is secured to cover 20 and provides a means for tethering a pacifier or the like to infant carrier 10.

Figure 4:
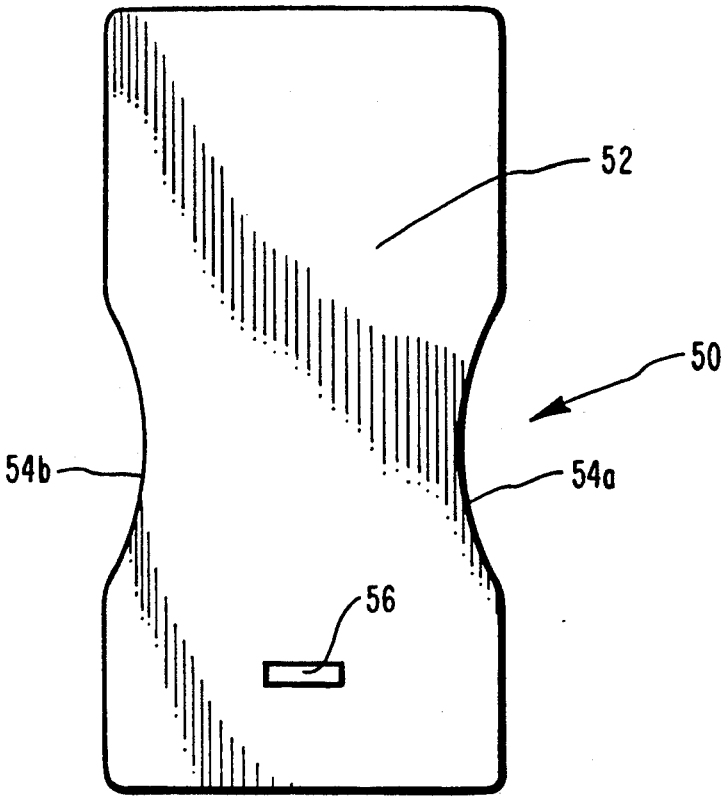
FIG. 4 is a plan view of the support board for the infant carrier.
Figure 5:
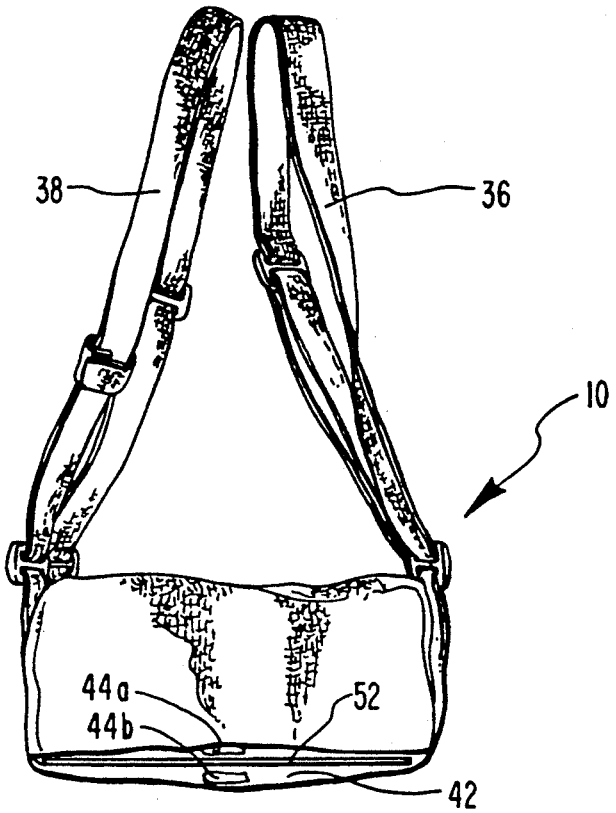
FIG. 5 is an end view of the infant carrier showing the support board inserted in its pocket below the bed of the infant carrier.

Referring now also to FIGS. 4 and 5, a stiffener board for infant carrier 10 is shown generally at 50 and is constructed from a board 52 fabricated from a pressed particle board commonly referred to as Masonite, plastic, cardboard, or the like. Board 52 is dimensionally configured to be received in a pocket 42 under bed 13 and releasably held therein by a hook and loop fastener system **44*a* and 44*b*. Board 52 includes arcuate cutout sections or cutouts 54*a* and 54*b* along each side. Cutouts 54*a* and 54*b* are designed to rest against the hip or side of person 60 carrying infant carrier 10. This arcuate indentation permits infant carrier 10 to rest closer to the body of person 60 bring the center of gravity of the same correspondingly closer to person 60 to thereby reduce shoulder and back fatigue for person 60. Further, the arcuate shape of cutouts 54*a* and 54*b* provides an extended contact surface against to hip or side of person 60 thereby substantially reducing the tendency for infant carrier 10 to adopt a side-to-side swinging motion upon person 60 commencing to walk. Otherwise, if the sides of board 52 were straight, the contact between board 52 and person 60 would be a very short distance (a point or point of contact, theoretically) with the result that side-to-side swinging of infant carrier 10 are more pronounced as person 60** is walking.

Stiffener board 50 is specifically configured to be removable from infant carrier 10 so that it will not interfere when infant carrier 10 is washed in a conventional washing machine. Stiffener board 50 includes a hole 56 which is designed to reside in registry with a corresponding hole 11 in bed 13 and hole 21 in cover 20 to accommodate passage of a seat belt (not shown) or other restraining strap for the purpose of securing infant carrier 10 in a car seat, stroller, or the like (not shown).

The Method

In practicing the method of this invention, infant carrier 10 is configured as a bassinet 12 having a bed 13 therein surrounded by sidewalls 14 and 15, head sidewall 16, and foot sidewall 18. Cover 20 is formed coextensive with foot sidewall 18 and bed 13 so that it can be mounted to sidewalls 14 and 15 in spaced relationship to bed 13 or configured as part of changing surface 40 in conjunction with bed 13 and foot sidewall 18. This important feature contributes significantly to the versatility of infant carrier 10 in that it readily converts from one configuration to the other.

A further advantage to infant carrier 10 is that it includes a number of pockets, pockets **26*a* and 26*b*, foot pocket 22, and internal pocket 42, each of which can be used for receiving any variety of items essential for the care and comfort of infant 30. Lanyard 21** serves as a tether for a pacifier or the like thereby rendering it readily accessible while preventing its accidental loss.

In use, cover 20 is partially released at zippers 24 and 25 of raised sidewalls 14 and 15, respectively, to allow the appropriate items to be placed in internal pocket 42 and to place infant 30 inside infant carrier 10. Cover 20 is then secured to raised sidewalls 14 and 15 to snugly enclose infant 30 inside infant carrier 10. Additional accessory items (not shown) are placed in pockets **26*a* and 26*b* as well as foot pocket 22. A pacifier or other item is then secured with lanyard 21. Carry straps 36 an 38 are selectively adjusted at adjustment buckles 37 and 39, respectively, to allow person 60 to comfortably carry infant carrier 10. Carry straps 36 and 38 are releasably secured by closure 33 to keep them together while being worn over the shoulder of person 60**.

Advantageously and importantly, infant carrier 10 supports infant 30 in a prone, face-to-face orientation with person 60 and in the safe, warm enclosure of infant carrier 10. In the unlikely event infant carrier 10 is inadvertently tilted downwardly, elasticized hood 17 prevents infant 30 from sliding out of infant carrier 10. Not only is infant 30 carried safely in a face-to-face orientation with person 60, infant 30 is also carried with relative ease because carry straps cross over the opposite shoulder of person 60 to permit infant carrier 10 to be carried in a relatively hands-free fashion. Further, even though person 60 is able to carry infant carrier 10 in this relatively hands-free fashion there is no requirement for a separate diaper bag or the like since all of the items that would have been carried in the diaper bag are easily carried in infant carrier 10 in a safe, convenient, and freely accessible manner.

Infant carrier 10 is configured such that it can be placed on any suitable surface leaving infant 30 safely secured therein. Infant carrier 10 then becomes a bed away from home for infant 30. When necessary, cover 20 and foot sidewall 18 are unfolded outwardly to form changing surface 40. Further, since infant carrier 10 doubles as a diaper bag, all of the items essential for changing infant 30 are readily accessible to person 60 thereby eliminating person 60 from turning away from infant 30 in order to retrieve something from the diaper bag. This means that infant 30 is under the constant surveillance of person 60 because everything person 60 needs is located adjacent infant 30.

Changing surface 40 is padded, soft, and warm to infant 30 so that infant 30 is protected from hard, cold surfaces which may or may not be in a sanitary condition. Once changed, infant 30 is again securely enclosed in infant carrier 10 by foot sidewall 18 and cover 20 being secured again to raised sidewalls 14 and 15.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An infant carrier comprising:

a transportable bed, said transportable bed including an external periphery and a head end and a foot end;

a raised sidewall around said external periphery of said transportable bed, said raised sidewall including a right sidewall, a left sidewall, a head end sidewall, and a foot end sidewall;

a cover for said transportable bed, said cover being formed as an extension of said foot end sidewall, said cover being removably attached to an incremental length of each of said right sidewall and said left sidewall;

a left carrying strap and a right carrying strap, said left carrying strap being formed as a left loop having a first left end and a second left end, said first left end being attached to said transportable bed adjacent said head end, said second left end being attached to said transportable bed adjacent said foot end, said right carrying strap being formed as a right loop having a first right end and a second right end, said first right end being attached to said transportable bed adjacent said head end, said second right end being attached to said transportable bed adjacent said foot end;

a board pocket underneath said transportable bed;

a support board removably inserted into said board pocket, said support board providing a stiffener for said transportable bed; and a canopy across a portion of said head end, said canopy extending inwardly an incremental distance from said raised sidewall and forming an opening between said canopy and said cover.

2. The infant carrier defined in claim 1 wherein said raised sidewall and said cover include a plurality of accessory pockets.

3. The infant carrier defined in claim 1 wherein said cover is detachable from said raised sidewalls and extendable from said foot end of said transportable bed to form a changing surface coextensive with said transportable bed.

4. The infant carrier defined in claim 1 wherein said infant carrier is fabricated from a washable fabric.

5. The infant carrier defined in claim 4 wherein said washable fabric includes padding on preselected surfaces.

6. The infant carrier defined in claim 1 wherein said cover includes a lanyard adapted for releasably securing a pacifier.

7. The infant carrier defined in claim 1 wherein said transportable bed includes a first hole and said cover includes a second hole in registry with said first hole, said first hole and said second hole being adapted for providing passage for a seat belt to releasably secure said infant carrier in a conventional car seat.

8. The infant carrier defined in claim 1 wherein said opening of said canopy is defined by an elasticized periphery on said canopy.

9. The infant carrier defined in claim 1 wherein said support board having a left side and a right side and a first indentation in said left side and a second indentation in said right side.

10. The infant carrier defined in claim 1 wherein said left carrying strap and said right carrying strap each includes adjustment means for selectively adjusting the length of each of said left carrying strap and said right carrying strap.

11. The infant carrier defined in claim 10 wherein said left carrying strap is conjoined to said right carrying strap underneath said transportable bed to provide improved safety to said infant carrier.

12. A transportable infant carrier for carrying an infant and assorted infant accessories comprising:

a bed, said bed comprising a padded surface having a head end, a foot end, a right side and a left side;

a cover formed coextensive with said bed at said foot end, said cover being foldable across a portion of said padded surface in spaced relationship to form an enclosure for the infant;

a raised sidewall surrounding said padded surface, said cover forming said raised sidewall at said foot end of said padded surface;

attachment means on said cover and said raised sidewall for releasably attaching said cover to said raised sidewall;

an elasticized canopy extending inwardly from said raised sidewall at said head end;

carrying strap means for carrying said transportable infant carrier, said carrying strap means comprising adjustment means for adjustably altering the length of said carrying strap means;

a stiffener board for supporting said bed;

a board pocket beneath said bed for removably receiving said stiffener board; and a plurality of accessory pockets in said raised sidewalls and said cover for receiving infant accessories.

13. The transportable infant carrier defined in claim 12 wherein said cover includes a changing surface upon detachment of said cover from said sidewalls and placement of said cover coplanar with said bed by folding said cover outwardly from said bed.

14. The transportable infant carrier defined in claim 13 wherein at least one of said plurality of accessory pockets is exposed upon transformation of said cover into said changing surface.

15. The transportable infant carrier defined in claim 12 wherein said cover includes a lanyard adapted for releasably securing a pacifier to said transportable infant carrier.

16. The transportable infant carrier defined in claim 12 wherein said bed includes a first hole adjacent said foot end and said cover includes a second hole in registry with said first hole when said cover is attached to said raised sidewall, said first hole and said second hole comprising securement means for securing said transportable infant carrier to an infant car seat or a stroller.

17. The transportable infant carrier defined in claim 12 wherein said stiffener board including a first side and a second side and an indentation along each side of said stiffener board, said indentations provide limited conformance for a person carrying said transportable infant carrier.

18. A method for carrying an infant in combination with accessories for the care of the infant comprising the steps of:

forming a padded bed for the infant;

surrounding said padded bed with a raised sidewall;

extending said padded bed into a changing surface by forming a cover coextensive with said padded bed; and creating an enclosure for the infant with the cover by releasably attaching said cover to said raised sidewall.

19. The method defined in claim 18 wherein said surrounding step includes mounting carrying straps to said padded bed and said raised sidewall.

20. The method defined in claim 18 including creating pockets in said raised sidewall and said cover.

21. The method defined in claim 18 wherein said forming step includes mounting a board pocket below said padded bed and inserting a stiffening board in said board pocket.

* * * * *